US008596510B2

(12) United States Patent
Liu

(10) Patent No.: US 8,596,510 B2
(45) Date of Patent: Dec. 3, 2013

(54) PNEUMATIC NAILING MACHINE WITH A WINDING AIR CHANNEL FOR EXHAUST

(75) Inventor: Angi Liu, Taichung (TW)

(73) Assignee: Basso Industry Corp, Taichung (TW)

( * ) Notice: Subject to any disclaimer, the term of this patent is extended or adjusted under 35 U.S.C. 154(b) by 269 days.

(21) Appl. No.: 13/236,379

(22) Filed: Sep. 19, 2011

(65) Prior Publication Data

US 2012/0067935 A1 Mar. 22, 2012

(30) Foreign Application Priority Data

Sep. 20, 2010 (TW) ..... 99131815 A

(51) Int. Cl.
*B25C 1/04* (2006.01)

(52) U.S. Cl.
USPC ..... 227/10; 227/130; 181/230

(58) Field of Classification Search
USPC ..... 227/9, 10, 130, 131; 181/230
See application file for complete search history.

(56) References Cited

U.S. PATENT DOCUMENTS

| | | | | |
|---|---|---|---|---|
| 4,401,251 | A * | 8/1983 | Nikolich | 227/130 |
| 4,509,669 | A * | 4/1985 | Elliesen | 227/130 |
| 4,667,572 | A * | 5/1987 | Elliesen | 91/461 |
| 5,878,936 | A * | 3/1999 | Adachi et al. | 227/130 |

* cited by examiner

*Primary Examiner* — Alexandra Elve
*Assistant Examiner* — Nathaniel Chukwurah
(74) *Attorney, Agent, or Firm* — Ladas & Parry, LLP

(57) ABSTRACT

A pneumatic nailing machine includes a striking cylinder accommodated in a main housing to permit a piston and driver assembly to be moved for driving a nail when compressed air is supplied into the cylinder. A valve member is movable relative to the cylinder between an air-supplying position and an air-exhausting position. A winding air channel has an intake port disposed downstream of a head valve zone, an outflow port angularly displaced from the intake port, and a channel body which extends radially from the intake port, axially into a mounting shell mounted on the main housing, and circumferentially toward the outflow port. Compressed air exhausted from the cylinder can expand in the air channel and the flow rate of the compressed air is reduced so as to efficiently attenuate noise.

12 Claims, 8 Drawing Sheets

PNEUMATIC NAILING MACHINE WITH A WINDING AIR CHANNEL FOR EXHAUST

CROSS-REFERENCE TO RELATED APPLICATION

This application claims priority of Taiwanese Patent Application No. 099131815, filed on Sep. 20, 2010, the disclosure of which is herein incorporated by reference.

BACKGROUND OF THE INVENTION

1. Field of the Invention

This invention relates to a pneumatic nailing machine, more particularly to a pneumatic nailing machine having a winding air channel for exhaust.

2. Description of the Related Art

Referring to FIGS. 1 and 2, a conventional pneumatic nailing machine 1 as disclosed in U.S. Pat. No. 5,878,936 is shown to include a striking cylinder 11 accommodated in a main housing 10, and a piston and driver assembly 12 disposed in the striking cylinder 11 and driven to drive a nail when compressed air is supplied to the striking cylinder 11 from an upper portion 111. As shown in FIG. 1, when a trigger is pulled to move a valve stem 16 to open a passage 17, compressed air in a head valve chamber 18 is exhausted so that a head valve 13 is opened, and compressed air in an air chamber 19 bursts into the striking cylinder 11 to drive the piston and driver assembly 12 so as to strike a nail. As shown in FIG. 2, when compressed air is supplied to the head valve chamber 18 so that the head valve 13 is closed while an exhaust port 141 is opened, the compressed air in the striking cylinder 11 is discharged through the exhaust port 141 to an exhaust chamber 142, and further through throttle holes 143 into be exhausted from outflow ports 144. Meanwhile, the piston and driver assembly 12 is moved back to its initial position so as to ready for the next nailing operation.

Since the compressed air exhausted from the striking cylinder 11 flows along a substantially axial path at a very high rate, a loud noise is generated even though the throttle holes 143, through which the exhausted compressed air flows, are provided.

SUMMARY OF THE INVENTION

An object of the present invention is to provide a pneumatic nailing machine which has a winding air channel for exhaust so as to attenuate noise generated as a result of flow of exhaust air.

According to this invention, the pneumatic nailing machine includes a main housing extending along an axis to terminate at front and rear ends. A mounting shell extends axially from the rear end. A rear cover shell extends axially from the mounting shell to terminate at a cover wall, and defines a head valve zone. A striking cylinder includes a front cylinder portion which is disposed in the main housing to cooperatively define an air chamber that is supplied with compressed air, and a rear cylinder portion which extends axially from the front cylinder portion to terminate at an access opening that confronts the cover wall. A piston and driver assembly is disposed in the striking cylinder and moved relative to the striking cylinder along the axis so as to drive a fastener when the compressed air is supplied to the striking cylinder. A first gate member is disposed between the rear cylinder portion and the mounting shell, and defines an inlet valve opening that is upstream of the access opening and downstream of the air chamber in terms of an air-supplying route. A second gate member is disposed between the rear cylinder portion and the rear cover shell, and defines an outlet valve opening that is upstream of the head valve zone and downstream of the access opening in terms of an air-exhausting route. A valve member includes inlet-side and outlet-side valve regions, and is movable between an air-supplying position, where the outlet-side valve region closes the outlet valve opening to interrupt fluid communication between the access opening and the head valve zone while the inlet-side valve region opens the inlet valve opening to establish fluid communication between the access opening and the air chamber, and an air-exhausting position, where the inlet-side valve region closes the inlet valve opening to interrupt the fluid communication between the access opening and the air chamber while the outlet-side valve region opens the outlet valve opening to establish the fluid communication between the access opening and the head valve zone. A winding air channel has an intake port which is formed in the rear cover shell, and which is disposed downstream of the head valve zone, an outflow port which is formed in and radially extending out of the mounting shell, and which is angularly displaced from the intake port about the axis, and a channel body which extends radially from the intake port, axially into the mounting shell, and toward the outflow port to form a plurality of mounting-shell-side consecutive channel segments that are upstream of the outflow port, each having a first circumferentially extending subsegment. Thus, the compressed air exhausted from the striking cylinder can expand in the air channel so that the flow rate of the compressed air is reduced, thereby efficiently attenuating noise generated as a result of the compressed air flow.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
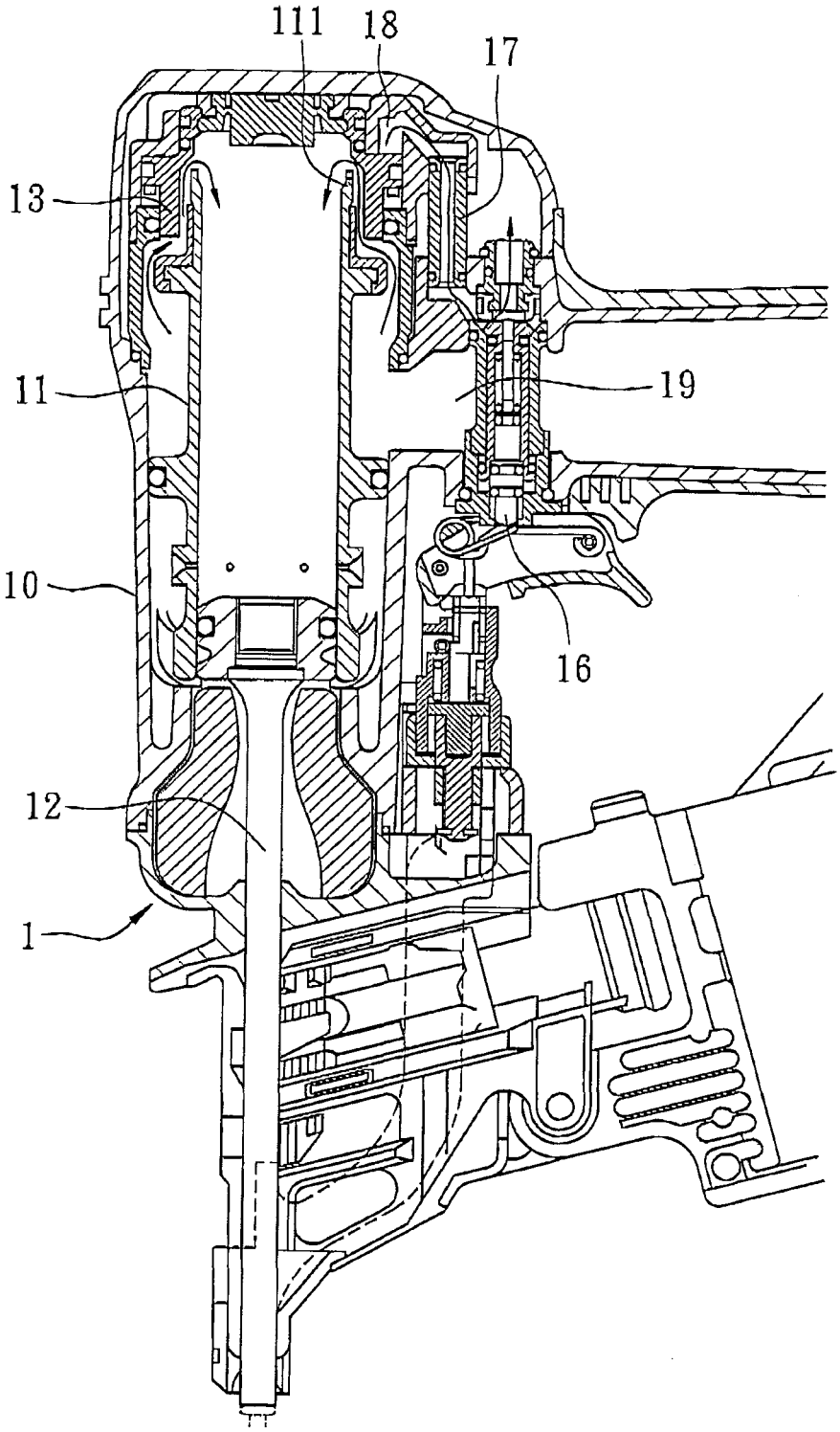
FIG. 1 PRIOR ART
FIG. 1 is a sectional view of a conventional pneumatic nailing machine of U.S. Pat. No. 5,878,936.
Figure 2:
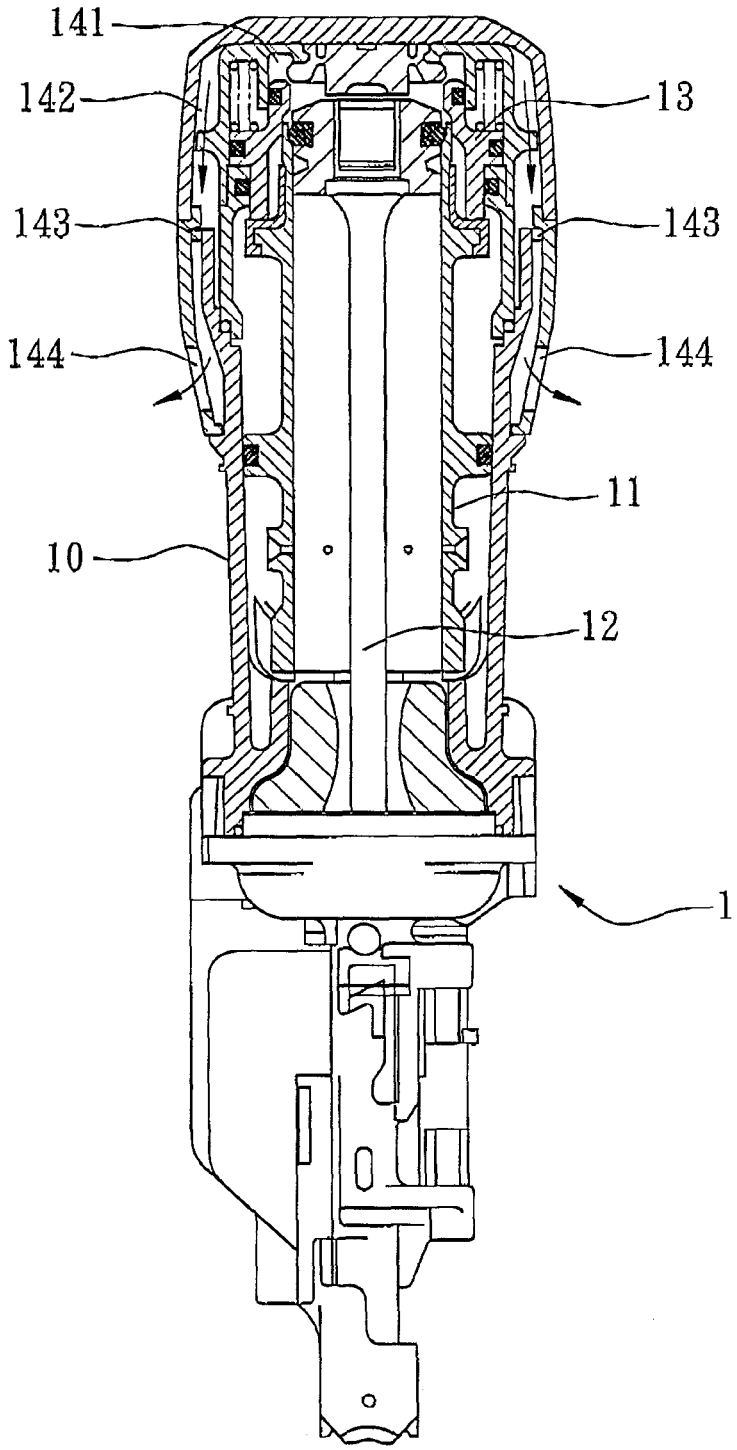
FIG. 2 PRIOR ART
FIG. 2 is a sectional view of the conventional pneumatic nailing machine taken on a section orthogonal to FIG. 1.
Figure 3:
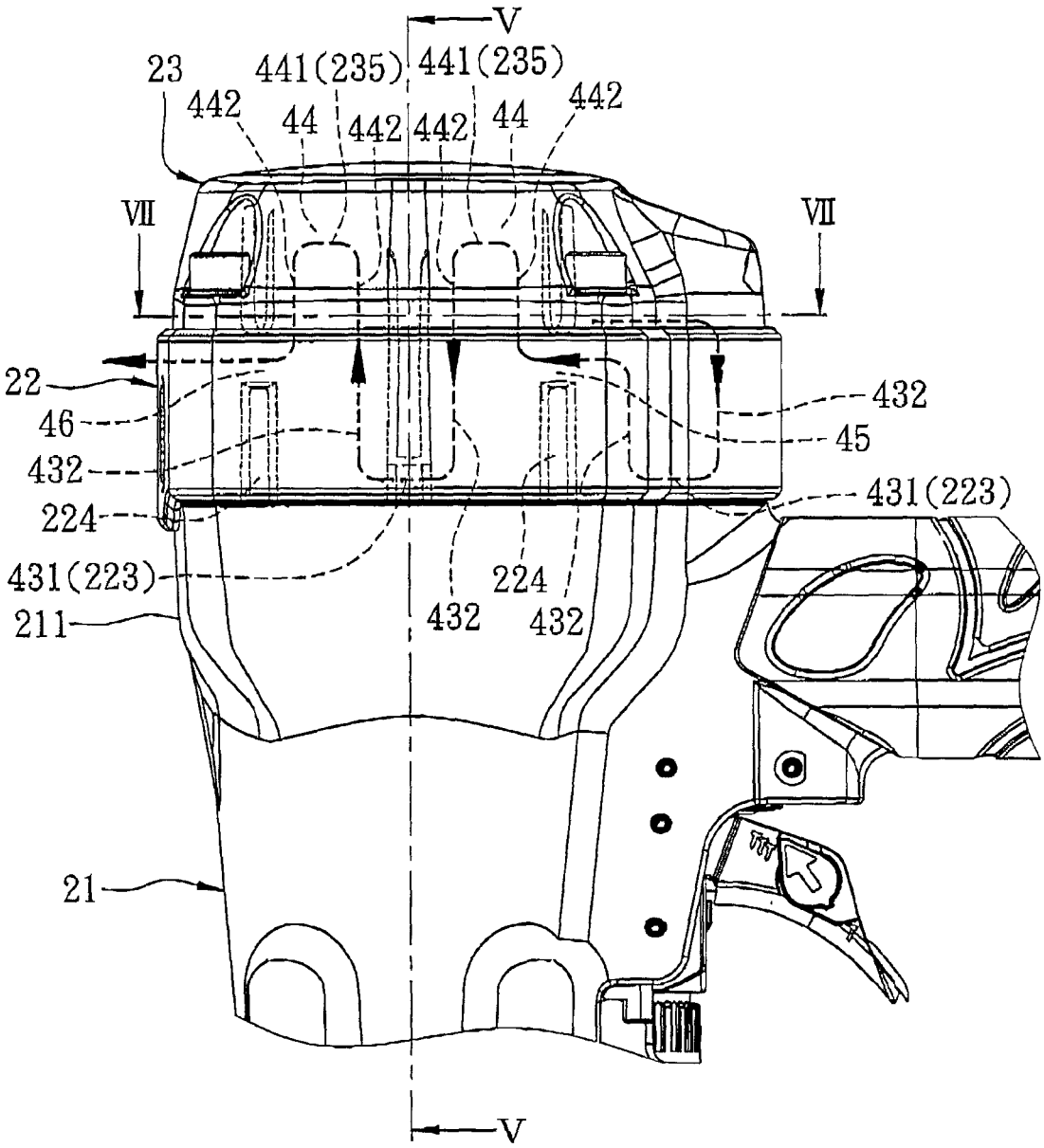
FIG. 3 is a fragmentary front view of the preferred embodiment of a pneumatic nailing machine according to this invention.
Figure 4:
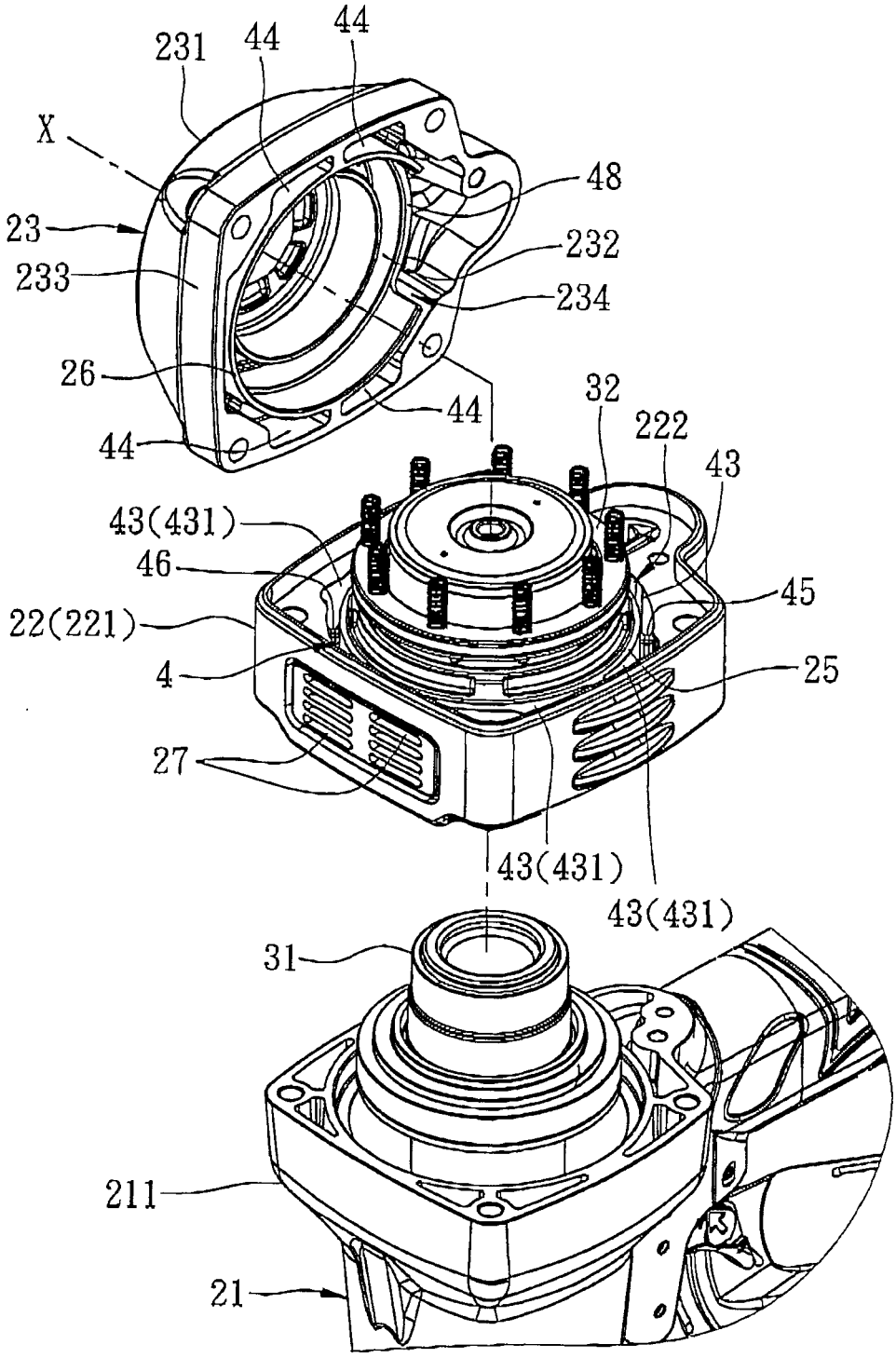
FIG. 4 is an exploded perspective view of a portion of the preferred embodiment.
Figure 5:
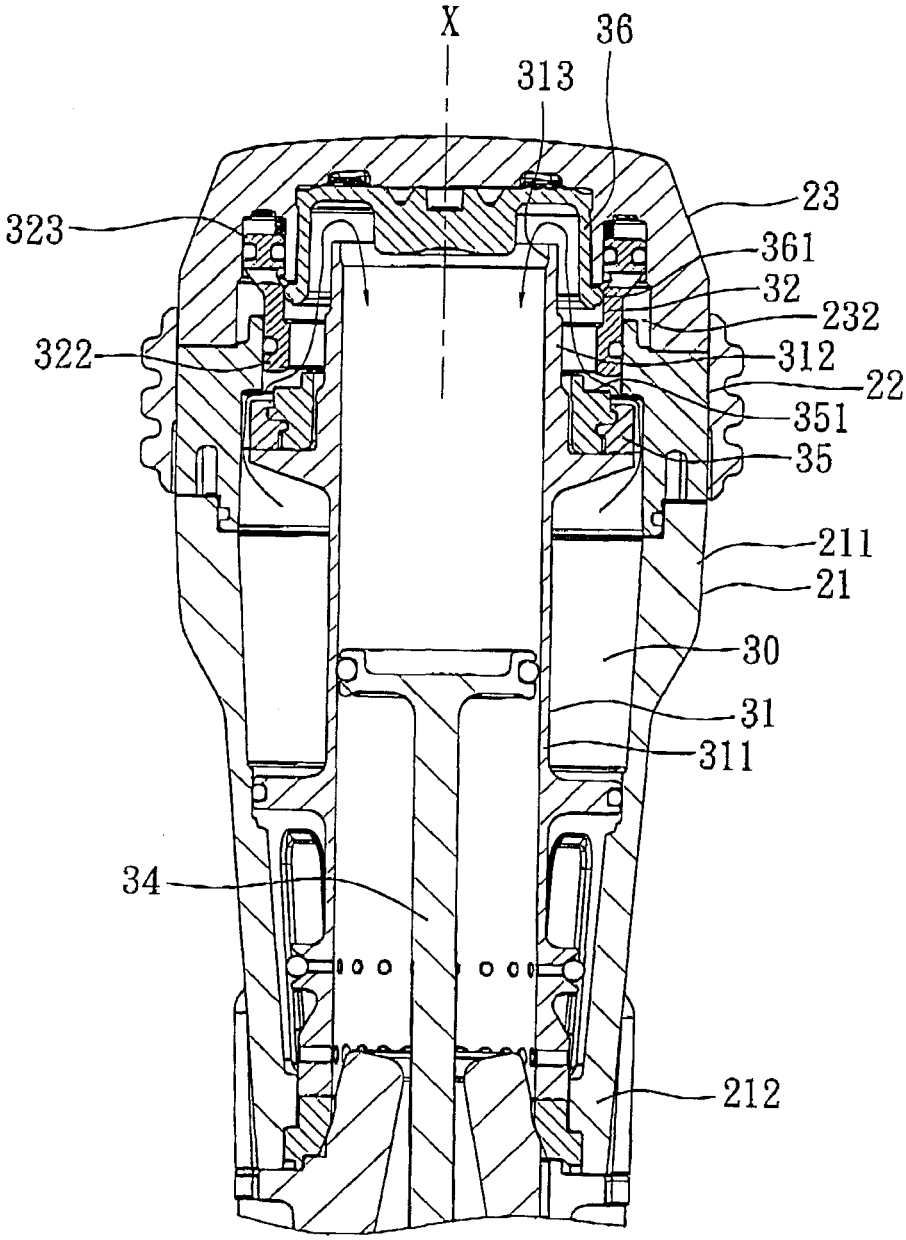
FIG. 5 is a sectional view taken along line V-V of FIG. 3.
Figure 6:
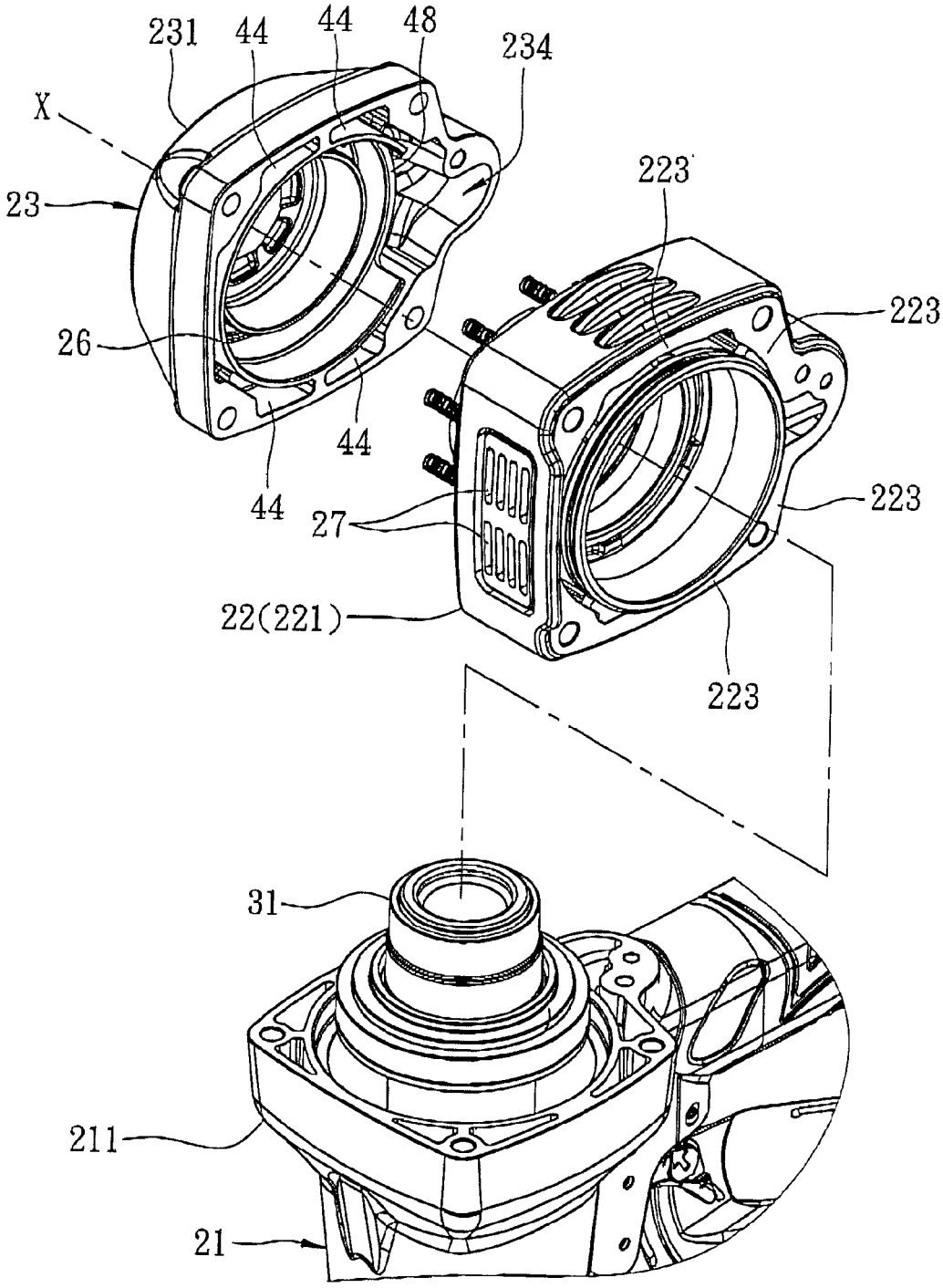
FIG. 6 is an exploded perspective view of the portion of the preferred embodiment.
Figure 7:
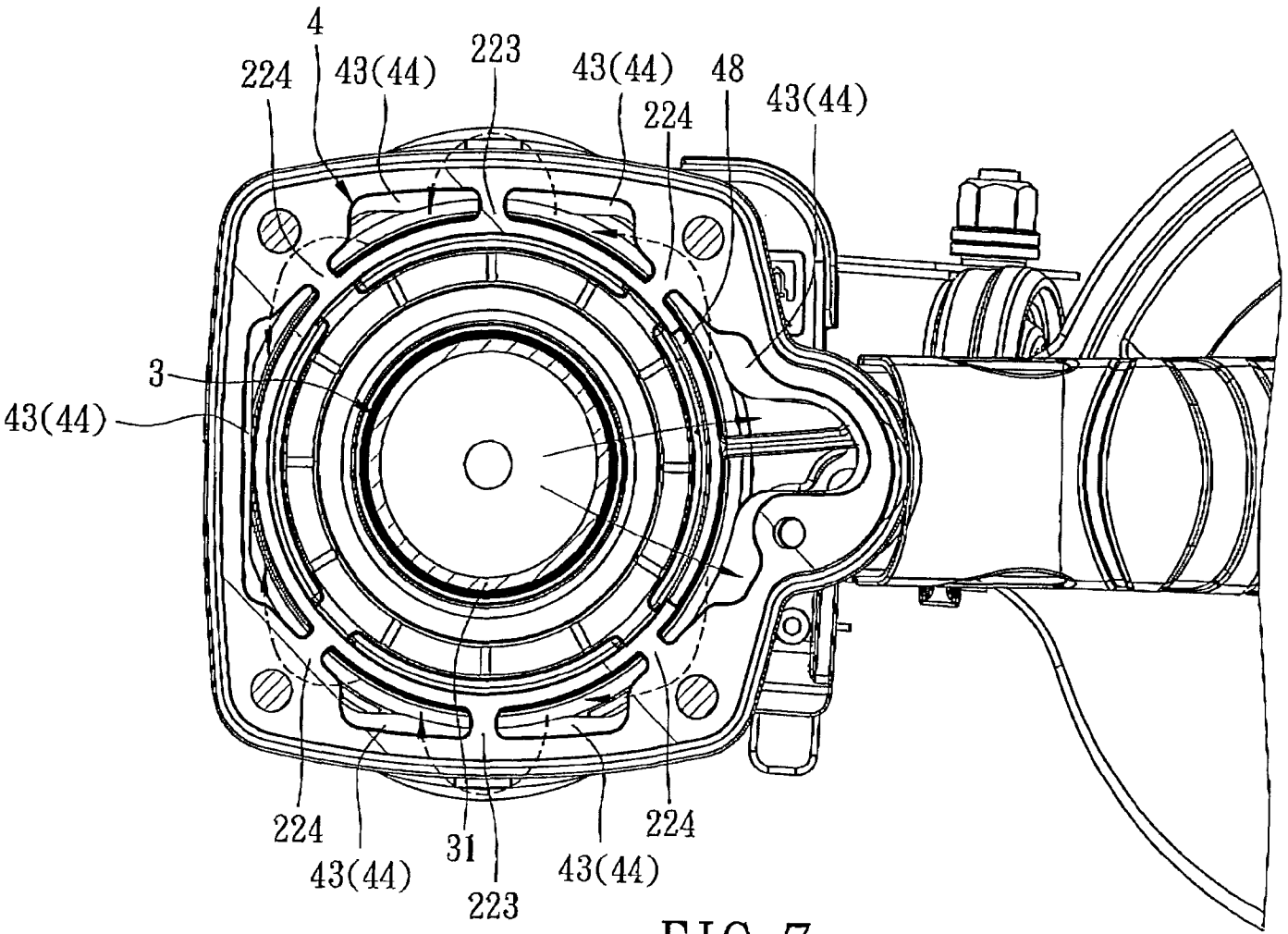
FIG. 7 is a cross-sectional view taken along line VII-VII of FIG. 3.

Referring to FIGS. 3 to 5, the preferred embodiment of a pneumatic nailing machine according to the present invention is shown to comprise a main housing 21 extending along an axis (X) to terminate at a rear end 211 and a front end 212 which is provided with a nosepiece (not shown). A mounting shell 22 is mounted on and extends axially from the rear end 211 of the main housing 21. A rear cover shell 23 is mounted on and extends axially from the mounting shell 22 to terminate at a cover wall 231, and defines a head valve zone 232.

The rear cover shell 23 may be integrally formed with the mounting shell 22. A striking cylinder 31 includes a front cylinder portion 311 which is disposed in the main housing 21 to cooperatively define an air chamber 30 that is supplied with compressed air, and a rear cylinder portion 312 which extends axially from the front cylinder portion 311 to terminate at an access opening 313 that confronts the cover wall 231. A piston and driver assembly 34 is disposed in the striking cylinder 31 and moved relative to the striking cylinder 31 along the axis (X) so as to drive a fastener (not shown) out of the nosepiece when the compressed air is supplied to the striking cylinder 31. A first gate member 35 is disposed between the rear cylinder portion 312 and the mounting shell 22, and defines an inlet valve opening 351 that is upstream of the access opening 313 and downstream of the air chamber 30 in terms of an air-supplying route. A second gate member 36 is disposed between the rear cylinder portion 312 and the rear cover shell 23, and defines an outlet valve opening 361 that is upstream of the head valve zone 232 and downstream of the access opening 313 in terms of an air-exhausting route.

Figure 8:
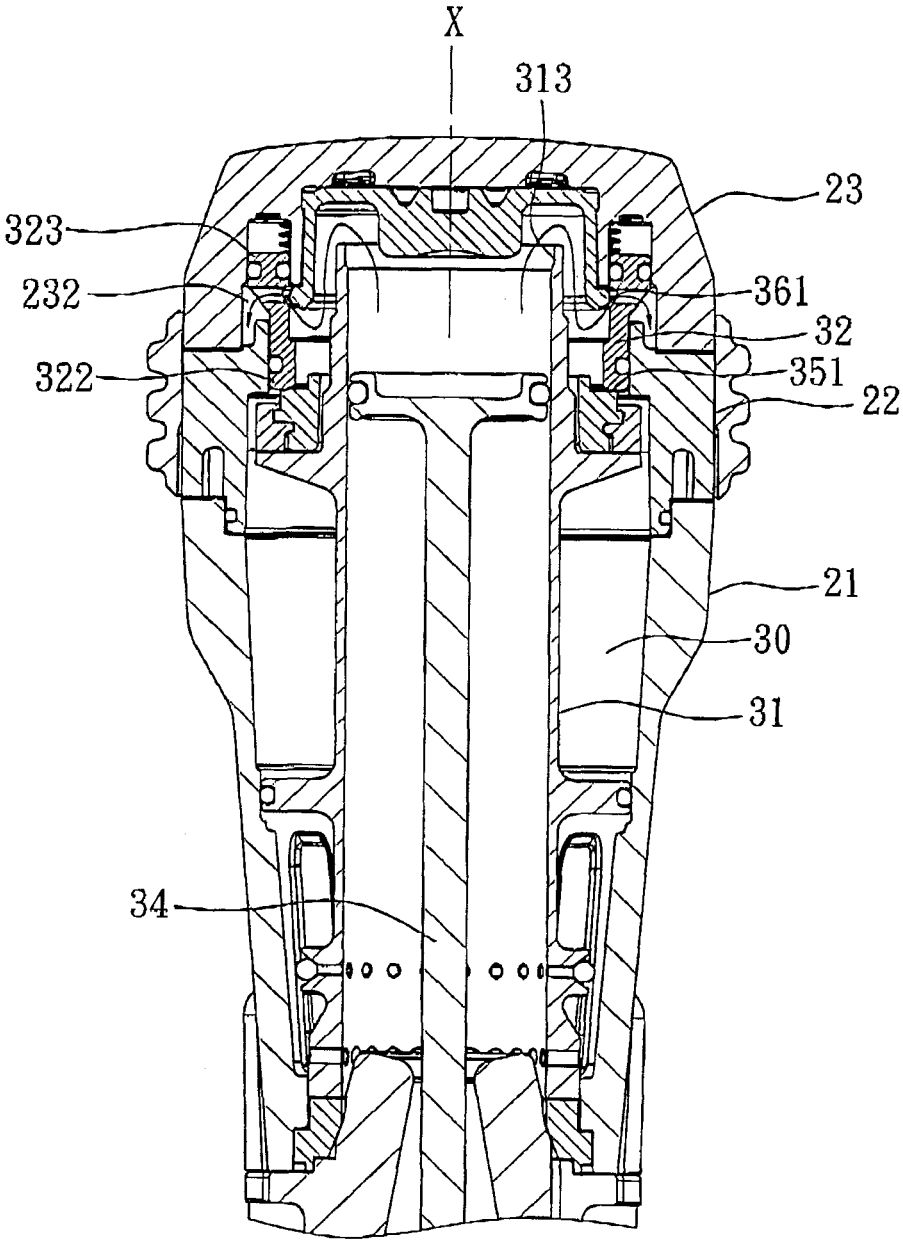
FIG. 8 is a sectional view illustrating the preferred embodiment during exhaust.

A valve member 32 includes inlet-side and outlet-side valve regions 322, 323, and is movable between an air-supplying position (FIG. 5), where the outlet-side valve region 323 closes the outlet valve opening 361 to interrupt fluid communication between the access opening 313 and the head valve zone 232 while the inlet-side valve region 322 opens the inlet valve opening 351 to establish fluid communication between the access opening 313 and the air chamber 30, and an air-exhausting position (FIG. 8), where the inlet-side valve region 322 closes the inlet valve opening 351 to interrupt the fluid communication between the access opening 313 and the air chamber 30 while the outlet-side valve region 323 opens the outlet valve opening 361 to establish the fluid communication between the access opening 313 and the head valve zone 232.

This embodiment further comprises a winding air channel 4 provided in the mounting shell 22 and the rear cover shell 23 for exhausting the compressed air in the striking cylinder 31.

Specifically, as shown in FIGS. 3, 4, 6 and 7, the mounting shell 22 has a surrounding shell body 221 which extends axially to terminate at a surrounding abutted surface 25, and which is configured to extend circumferentially. The surrounding shell body 221 has a circumferentially extending trench 222.

Hence, the winding air channel 4 has an outflow port 27 which is formed in and extends radially out of the surrounding shell body 221, and a channel body which includes a plurality of mounting-shell-side consecutive channel segments 43 formed in the circumferentially extending trench 222. Each of the channel segments 43 has a first circumferentially extending subsegment 431 and two consecutive first axially extending subsegments 432 which are interconnected by the first circumferentially extending subsegment 431. The circumferentially extending trench 222 extends axially so as to accommodate the orientation of the first axially extending subsegments 432, i.e., a forward-and-rearward direction. Further, the surrounding shell body 221 has a plurality of first baffle ribs 223 which are disposed in the circumferential extending trench 222, and which are angularly displaced from each other about the axis (X). Each of the first baffle ribs 223 is disposed forwardly from the surrounding abutted surface 25. Furthermore, the surrounding shell body 221 has a plurality of first baffle posts 224 which are alternately arranged with and angularly displaced from the first baffle ribs 223 and which respectively define a plurality of passages 45, 46, each communicating two adjacent ones of the first axially extending subsegments 432 of two consecutive ones of the mounting-shell-side consecutive channel segments 43.

The rear cover shell 23 has a tubular wall 233 which extends axially from a periphery of the cover wall 231 to terminate at a surrounding abutting surface 26 that is in abutting engagement with the surrounding abutted surface 25 of the mounting shell 22, and which extends circumferentially. The tubular wall 233 has a circumferentially extending groove 234.

The winding air channel 4 further has an intake port 48 which is formed in the rear cover shell 23 to be downstream of the head valve zone 232 and upstream of the circumferentially extending groove 234, and which is angularly displaced from the outflow port 27 about the axis (X). Preferably, the intake port 48 and the outflow port 27 are formed at two diametrically opposite sides with respect to the axis (X). The channel body further includes a plurality of cover-shell-side consecutive channel segments 44 formed in the circumferentially extending groove 234. Each of the cover-shell-side consecutive channel segments 44 has a second circumferentially extending subsegment 441 and two second axially extending subsegments 442 interconnected by the second circumferentially extending subsegment 441. The circumferentially extending groove 234 extends axially so as to accommodate the orientation of the second axially extending subsegments 442, i.e., the forward-and-rearward direction, and is in spatial communication with the circumferentially extending trench 222 to thereby expand axially the winding air channel 4 to the tubular wall 233. Further, the tubular wall 233 has a plurality of second baffle ribs 235 which are disposed in the circumferentially extending groove 222, and which are angularly displaced from each other about the axis (X). Each of the second baffle ribs 235 is disposed rearwardly from the surrounding abutting surface 26. Thus, the channel body extends radially from the intake port 48, axially into the mounting shell 22, and circumferentially toward the outflow port 27

With such winding air channel 4, the compressed air in the striking cylinder 31 flows alternately along the mounting-shell-side consecutive channel segments 43 and the cover-shell-side consecutive channel segments 44 which are alternately arranged and angularly displaced from each other, thereby resulting in expansion of the compressed air in the air channel 4 so as to reduce the flow rate of the compressed air, thereby efficiently attenuating noise generated as a result of the compressed air flow. Moreover, since the winding air channel 4 is provided in an interior space of the mounting shell 22 and the rear cover shell 23 without the need to enlarge the volume of the nailing machine, and made by superimpose the rear cover shell 23 and the mounting shell 22 upon the rear end 211 of the main housing 21, the nailing machine may be made compact and is readily assembled.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A pneumatic nailing machine comprising:

a main housing extending along an axis to terminate at a rear end and a front end;

a mounting shell extending axially from said rear end;

a rear cover shell extending axially from said mounting shell to terminate at a cover wall, and defining a head valve zone;

a striking cylinder including a front cylinder portion which is disposed in said main housing to cooperatively define an air chamber that is supplied with compressed air, and a rear cylinder portion which extends axially from said front cylinder portion to terminate at an access opening that confronts said cover wall;

a piston and driver assembly disposed in said striking cylinder and moved relative to said striking cylinder along the axis so as to drive a fastener out of said main housing when the compressed air is supplied to said striking cylinder;

a first gate member which is disposed between said rear cylinder portion and said mounting shell, and which defines an inlet valve opening that is upstream of said access opening and downstream of said air chamber in terms of an air-supplying route;

a second gate member which is disposed between said rear cylinder portion and said rear cover shell, and which defines an outlet valve opening that is upstream of said head valve zone and downstream of said access opening in terms of an air-exhausting route;

a valve member including inlet-side and outlet-side valve regions, and movable between an air-supplying position, where said outlet-side valve region closes said outlet valve opening to interrupt fluid communication between said access opening and said head valve zone while said inlet-side valve region opens said inlet valve opening to establish fluid communication between said access opening and said air chamber, and an air-exhausting position, where said inlet-side valve region closes said inlet valve opening to interrupt the fluid communication between said access opening and said air chamber while said outlet-side valve region opens said outlet valve opening to establish the fluid communication between said access opening and said head valve zone; and a winding air channel having an intake port which is formed in said rear cover shell, and which is disposed downstream of said head valve zone, an outflow port which is formed in and extends radially out of said mounting shell, and which is angularly displaced from said intake port about the axis, and a channel body which extends radially from said intake port, axially into said mounting shell, and toward said outflow port to form a plurality of mounting-shell-side consecutive channel segments that are upstream of said outflow port, each having a first circumferentially extending subsegment.

2. The pneumatic nailing machine as claimed in claim 1, wherein said intake port and said outflow port are formed at two opposite sides with respect to the axis.

3. The pneumatic nailing machine as claimed in claim 2, wherein said mounting shell has a surrounding shell body which extends axially to terminate at a surrounding abutted surface, and which is configured to extend circumferentially so as to accommodate said first circumferentially extending subsegments of said mounting-shell-side consecutive channel segments.

4. The pneumatic nailing machine as claimed in claim 3, wherein each of said mounting-shell-side consecutive channel segments includes two consecutive first axially extending subsegments which are interconnected by said first circumferentially extending subsegment.

5. The pneumatic nailing machine as claimed in claim 4, wherein said surrounding shell body has a circumferentially extending trench which extends axially so as to accommodate orientation of said first axially extending subsegments.

6. The pneumatic nailing machine as claimed in claim 5, wherein said surrounding shell body has a plurality of first baffle ribs which are disposed in said circumferential extending trench, and which are angularly displaced from each other about the axis, each of said first baffle ribs being disposed forwardly from said surrounding abutted surface.

7. The pneumatic nailing machine as claimed in claim 6, wherein said surrounding shell body has a plurality of first baffle posts which are alternately arranged with and angularly displaced from said first baffle ribs and which respectively define a plurality of passages each communicating two adjacent ones of said first axially extending subsegments of two consecutive ones of said mounting-shell-side consecutive channel segments.

8. The pneumatic nailing machine as claimed in claim 7, wherein said channel body further forms a plurality of cover-shell-side consecutive channel segments, each having a second circumferentially extending subsegment and two second axially extending subsegments interconnected by said second circumferentially extending subsegment.

9. The pneumatic nailing machine as claimed in claim 8, wherein said rear cover shell has a tubular wall which extends axially to terminate at a surrounding abutting surface that is in abutting engagement with said surrounding abutted surface, and which extends circumferentially so as to accommodate said second circumferentially extending subsegments of said cover-shell-side consecutive channel segments.

10. The pneumatic nailing machine as claimed in claim 9, wherein said tubular wall has a circumferentially extending groove which extends axially so as to accommodate the orientation of said second axially extending subsegments and which is in spatial communication with said circumferentially extending trench, thereby expanding axially said winding air channel to said tubular wall.

11. The pneumatic nailing machine as claimed in claim 10, wherein said tubular wall has a plurality of second baffle ribs which are disposed in said circumferentially extending groove, and which are angularly displaced from each other about the axis, each of said second baffle ribs being disposed rearwardly from said surrounding abutting surface.

12. The pneumatic nailing machine as claimed in claim 1, wherein said rear cover shell is integrally formed with said mounting shell.

* * * * *